US007572485B2

(12) United States Patent
Sandor

(10) Patent No.: US 7,572,485 B2
(45) Date of Patent: Aug. 11, 2009

(54) REMOVABLE GLAZE AND TEXTURED PAINT SYSTEM FOR DECORATIVE FINISHING

(76) Inventor: Raymond Sandor, 3435 Aviation Blvd., Vero Beach, FL (US) 32960

( * ) Notice: Subject to any disclaimer, the term of this patent is extended or adjusted under 35 U.S.C. 154(b) by 0 days.

(21) Appl. No.: 11/859,128

(22) Filed: Sep. 21, 2007

(65) Prior Publication Data

US 2008/0008821 A1 Jan. 10, 2008

Related U.S. Application Data

(63) Continuation-in-part of application No. 11/085,801, filed on Mar. 21, 2005, now Pat. No. 7,473,438.

(60) Provisional application No. 60/555,439, filed on Mar. 22, 2004.

(51) Int. Cl.
*B05D 5/00* (2006.01)
*B05D 3/12* (2006.01)

(52) U.S. Cl. ..... 427/262; 427/265; 427/274

(58) Field of Classification Search ..... None
See application file for complete search history.

(56) References Cited

U.S. PATENT DOCUMENTS

| | | | | |
|---|---|---|---|---|
| 3,639,160 | A * | 2/1972 | Nelson | 427/226 |
| 6,630,533 | B2 * | 10/2003 | Konopka et al. | 524/560 |
| 6,727,315 | B2 | 4/2004 | Yamamoto et al. | |
| 2002/0009622 | A1 * | 1/2002 | Goodson | 428/703 |

OTHER PUBLICATIONS

Encycl. of Mat. Sci., see 1449.*
M-H Dictionary of Chemistry, see 1449.*
Encyclopedia of Materials Science and Engineering, pp. 3648-3649, 1986.
McGraw Hill Dictionary of Chemistry, pp. 309, 1997.

* cited by examiner

*Primary Examiner*—Frederick J Parker
(74) *Attorney, Agent, or Firm*—Feldman Gale, P.A.; David A. Cherry

(57) ABSTRACT

Decorative finishes and processes for making same are described. The finishes contain a a vinyl polymer, water, a glycol, and activator and optionally color and a functional filler. The finishes are applied to a substrate to produce a finish that may be modified following application.

21 Claims, No Drawings

REMOVABLE GLAZE AND TEXTURED PAINT SYSTEM FOR DECORATIVE FINISHING

CROSS REFERENCES TO RELATED APPLICATIONS

This application is a continuation-in-part of U.S. patent application Ser. No. 11/085,801, filed Mar. 21, 2005, now U.S. Pat. No. 7,473,438, which claims the benefit under 35 U.S.C. § 119(e) of U.S. Provisional Application No. 60/555,439, filed Mar. 22, 2004, the complete disclosures of which are hereby incorporated herein by reference in their entirety.

FIELD OF THE INVENTION

The present invention lies in the field of finishes, in particular, novel faux finishes and processes for their application to surfaces. More particularly, the invention relates to materials and compositions for the production and application of decorative finishes that provide greater flexibility in modifying, shaping and manipulating the finish.

BACKGROUND OF THE INVENTION

The creation of imitation marble, granite, and other finishes has been practiced for many years. Traditionally, an artisan manually applies paint to a surface and manipulates it into a pattern that seeks to duplicate the appearance of natural materials. These "faux" finishes are desirable because they may be used when the original materials are not available, are too expensive, or their use is impracticable or unfeasible.

Given the flexibility offered by these finishes, artisans often endeavor to recreate the look of aged walls, marble, rare stone, fine wood, textiles, plasters and textures finishes, along with simulating natural aging and distressing of materials. Regardless of the specific project, attention to detail, proper technique, and appropriate materials are critical to lending authenticity and believability to the appearance of the surface being displayed.

Certain techniques and finishes have been devised to manipulate paints or colorants into assuming a desirable surface while attempting to minimize the need for detailed manipulation by the artisan. Despite the variety of techniques and finishes available, these finishes are often difficult to work with, particularly following their application to the surface to be decorated. For example, current techniques and finishes do not provide the artisan with sufficient time and flexibility to manipulate the finish into a desired position and/or texture well after the finish has been allowed to partially dry on the substrate. To the contrary, in most cases, the applied materials dry, adhere, react or bond quickly, thereby dissipating the malleable qualities of the finish over short periods of time.

Another disadvantage of current finishes and techniques is the inability to cleanly and sharply remove the finish from the substrate. This disadvantage is not only attributable to the rapid reactive and drying rates associated with currently available finishes, but also due to the thin layer that typically forms. Ultimately, this poses a significant disadvantage when the artisan is displeased with the initial application, elects another artistic result or chooses to expose portions of the surface beneath the finish.

Therefore, there is a need for a decorative faux finish that, when applied to a substrate, provides the artisan with a sufficient amount of time and flexibility to manipulate the finish into a desired texture and appearance. Although such finishes would preferably be modifiable for suitable periods of time, when fully dry, the finish would adhere to the underlying substrate to a similar degree of existing finishes. It would also be desirable to provide a finish that, when applied to a substrate, provides a puffed and grainy structure that is very easy to cleanly and sharply remove from the surface on which it is applied.

SUMMARY OF THE INVENTION

Accordingly, it is an object of the present invention to provide decorative finishes and processes that overcome the disadvantages and/or offer new advantages over existing materials and techniques.

It is another object of the invention to provide decorative finishes and processes that provide smooth, partially smooth, textured or rough decorative surfaces.

It is another object of the invention to provide finishes and processes that may be used to imitate glazes, textured stone, marble, granite, plaster and other surfaces.

It is another object of the invention to provide finishes and processes that allow greater flexibility following the application of the finish to a substrate, including the ability to work with the finish over time. These and other objects of the present invention will become evident from the detailed description of the invention.

DETAILED DESCRIPTION OF THE INVENTION

In a first embodiment, the present invention provides a process for making a faux finish, the process comprising the steps of: (a) contacting a base material liquid comprising propylene glycol and a vinyl polymer selected from the group consisting of polyvinyl acetate, polyvinyl alcohol and a mixture of polyvinyl acetate and polyvinyl alcohol; with an activating liquid comprising water and an activator selected from the group consisting of a boric acid compound and muriate of potash to form a finish; and (b) applying the finish to a surface.

In certain embodiments, the process further comprises the step of (c) allowing the finish to completely dry or (c) altering the shape of the finish about fifteen minutes to about one hour after the finish has been applied to the surface. In certain embodiments, the vinyl polymer comprises about 5% to about 25% by weight of solids of an aqueous dispersion of a polymer of vinyl acetate having protective colloids of polyvinyl alcohol. In certain embodiments, the propylene glycol is present in an amount of about 1% to about 50% by weight. In certain embodiments, the activator is sodium tetra borate decahydrate having a ratio of about 0.5 to about 10 ounces by volume of sodium tetra borate decahydrate dry powder per gallon of water. In certain embodiments, the base material liquid further comprises about 10% to about 80% by weight of water and about 5% to about 70% by weight of a functional filler. In certain embodiments, the present invention discloses faux finishes made according to the processes described herein.

In another embodiment, the present invention provides a process for making a faux finish, the process comprising contacting: (a) a vinyl polymer; (b) water; (c) a glycol; and (d) an activator; to form a finish.

In certain embodiments, the vinyl polymer is selected from the group consisting of polyvinyl acetate, polyvinyl alcohol and a mixture of polyvinyl acetate and polyvinyl alcohol; the glycol is propylene glycol; and the activator is selected from the group consisting of muriate of potash and a boric acid compound. In certain embodiments, the vinyl polymer is present in an amount of about 1% to about 25% by weight; the glycol is present in an amount of about 20% to about 50% by weight; and the activator is present in an amount of about 3% to about 10% by weight. In certain embodiments, the process further comprises applying the finish to a surface and allowing the finish to completely dry. In certain embodiments, the process further comprises applying the finish to a surface and altering the shape of the finish about five minutes to about one hour after the finish has been applied to the surface. In certain embodiments, contacting comprises the steps of: (1) contacting the vinyl alcohol, the glycol, the water and the activator to form the finish; and (2) applying the finish to a surface. In certain embodiments, contacting comprises the steps of: (1) contacting the activator with a portion of the glycol to form an activating liquid; (2) applying the activating liquid to a surface; (3) contacting the vinyl alcohol with another portion of the glycol to form a base material liquid; and (4) applying the base material liquid onto the activating liquid to form the finish.

In another embodiment, the present invention provides a process for making a faux finish, the process comprising (1) contacting a vinyl polymer and a glycol to form a base material liquid; (2) applying the base material liquid to a surface; (3) contacting an activator with water to form an activating liquid; and (4) applying the activating liquid onto the base material liquid to form a finish.

In certain embodiments, the vinyl polymer is selected from the group consisting of polyvinyl acetate, polyvinyl alcohol and a mixture of polyvinyl acetate and polyvinyl alcohol; the glycol is propylene glycol; and the activator is selected from the group consisting of muriate of potash and a boric acid compound. In certain embodiments, the vinyl polymer is present in an amount of about 1% to about 25% by weight; the glycol is present in an amount of about 20% to about 50% by weight; and the activator is present in an amount of about 3% to about 10% by weight. In certain embodiments, the process further comprises adding a colorant to the base material liquid. In certain embodiments, the process further comprises allowing the finish to completely dry. In certain embodiments, the process further comprises altering the shape of the finish after about 5 minutes to about one hour of applying the activating liquid onto the base material liquid. In certain embodiments, the process further comprises partially removing the finish after about 5 minutes to about one hour to expose the colorant in the base material liquid. In certain embodiments, the process further comprises altering the finish by one or more of touching, brushing, rubbing, manipulating, burnishing, troweling, toweling, sponging, flattening or removing the finish.

In another embodiment, the present invention provides a faux finish consisting essentially of: (a) a vinyl polymer; (b) water; (c) a glycol; (d) an activator; and (d) one or more fillers. In certain embodiments, the finish does not contain phosphoric acid. In certain embodiments, the vinyl polymer is selected from the group consisting of polyvinyl acetate, polyvinyl alcohol and a mixture of polyvinyl acetate and polyvinyl alcohol; the glycol is propylene glycol; the activator is selected from the group consisting of muriate of potash and a boric acid compound. In certain embodiments, the vinyl polymer is present in an amount of about 1% to about 25% by weight; the glycol is present in an amount of about 20% to about 50% by weight; the activator is present in an amount of about 3% to about 10% by weight; the water is present in an amount of about 10% to about 80% by weight; and the one or more fillers is present in an amount of about 5% to about 70% by weight. In certain embodiments, the finish is capable of being altered about 15 minutes to about 1 hour after it is applied to a substrate. In certain embodiments, the finish is capable of being altered about 15 minutes to about 1 hour after it is applied to a substrate.

The finishes of the present invention may be used with any suitable substrate (i.e., surface). Suitable substrates include those that are capable of accepting and maintaining a decorative finish by sufficiently adhering or bonding to the applied finishing materials. Typically, the substrate will be a surface of a piece of furniture, a wall panel, or any other surface on which someone desires to effectuate a desired pattern or imitate marble, granite or some other material of construction. Preferably, the substrates will have a textured and/or bondable surface. Examples of suitable substrates include, without limitation, drywall, plaster, plywood, siding, asphalt, concrete, granite, wood, metal, glass and the like. Although smooth finishes are certainly encompassed by the present invention, generally, the rougher the surface of the substrate, the stronger the adhesion will be between the substrate and the materials being applied to it.

In addition to being textured or non-textured, the substrate may be colored or uncolored. If desired, a color-tintable, paint-like base material may be applied to the substrate prior to the addition of any other materials. It is advantageous if the color-tintable, paint-like base material provides enhanced adhesion and wear properties. By way of illustration, carbonates, oxides, certain sulphates, nitrates, and titanates present in the paint may produce a composition with enhanced adhesion, toughness, scuff resistance, water resistance, chemical stability, oxidation resistance, durability and/or an increase in overall lifetime. Specific examples of paint-like base materials are acrylic base latex paints which, when dry, present a particularly suitable bondable surface. Oil-base flat paints and lacquer primer surfacers that produce a color absorbent and bondable surface may also be used. If the substrate is metal, it may be advantageous to apply a suitable primer before painting. Alternatively, with metal as well as other surfaces (e.g., plastic, wood, slate, glass, etc.), a layer of absorbent paper or cloth may be cemented to the substrate. In any use of paint, paper or cloth to form an absorbent surface, it may be variegated or all white, black or colored.

The finishes of the present invention include one or more of a vinyl polymer, a glycol, an activator, water, colorants and fillers. It will be appreciated that these materials may be contacted in a variety of manners and orders without deviating from the scope of the present invention. Thus, in certain circumstances, all of the materials may be combined in a single vessel. Alternatively, it may be desirable to combine two or more materials to create layers for the sake of assisting in the efficient administration of the materials to the substrate or creating finishes of different color, consistency, thickness, quality, quantity, etc. Although all manners of combination are contemplated, when layers are used the activator is preferably separated from the vinyl polymer. Under such circumstances, the layer containing the vinyl polymer serves as a "base material liquid" and the layer containing the activator serves as an "activating liquid." By way of further illustration, the vinyl polymer and the glycol may be combined to create a base liquid material and the activator and water may be combined to form an activating liquid. It will be appreciated that additional glycol, water, colorants and fillers may be further added alone or in combination in either layer as desired.

In order to further describe the methods of the present invention, certain parameters such as amounts, times, orders of addition, etc. are provided. It will be appreciated that these parameters may not account for every situation encountered. For example, because the components in the finish may be combined in a variety of manners, the percentages of the components will often change as the finish is developed. This is particularly true given the potential for liberal use of water, glycol, fillers, colors, etc. where the precise amounts will depend on the desired consistency, appearance or application. Moreover, percentages may depend on whether a particular component is added in a single vessel or in a layer. Similarly, time periods may be longer or shorter depending upon the triggering event used. Thus, due to the versatility of the invention, the parameters provided herein are given for general guidance as one of ordinary skill in the art would appreciate the variables at issue and/or be able to make adjustments to achieve the desired result. Furthermore, where ranges are cited herein, the ranges include the end points and every increment within the range. By way of illustration a range of about 1% to about 5% includes 1%, 2%, 3%, 4% and 5%.

The term vinyl polymer is intended to have its art-recognized meaning as a polymer made from vinyl monomers. Vinyl polymers that may be used are those capable of serving as a constituent in the finishes described herein. Preferred vinyl polymers include without limitation polyvinyl acetate, polyvinyl alcohol or a combination thereof. These vinyl polymers are well-known to the skilled artisan and commercially available. Polyvinyl acetate (also known by the acronyms PVA or PVAc) is a rubbery synthetic polymer typically prepared by polymerization of vinyl acetate monomer. In turn, polyvinyl alcohol (also known by the acronyms PVOH, PVA, or PVAL) is a water soluble polymer that has excellent film forming, emulsifying, and adhesive properties and is generally resistant to oil, grease and solvent. Polyvinyl alcohol also offers the added benefit of being odorless and nontoxic.

The vinyl polymers may have any level of purity so long as the polymers are operative in the finish. However, it will be appreciated that partial or complete hydrolysis of polyvinyl acetate provides polyvinyl alcohol, and as such, even completely hydrolyzed alcohol product may be in the range of about 85% to about 99% by weight (converted PVA). Thus, even commercially available polyvinyl acetate may contain polyvinyl alcohol or vice versa. This anomaly will be appreciated by the skilled artisan and is contemplated by the present invention. Alternatively, the present invention contemplates deliberately mixing these two polymers in various percentages depending on the desired application. Where polyvinyl acetate or polyvinyl alcohol is used alone, the amount is preferably about 1% to about 15% by weight. More preferably, the amount of the polymer is about 1% to about 5% by weight. Where a combination of polyvinyl acetate and polyvinyl alcohol is used, the amount is preferably 1% to about 25% by weight. More preferably, the amount of the combination is about 5% to about 15% by weight. In certain situations, the vinyl polymers may be resin solids. In such situations, the combined vinyl polymers will preferably be present in an amount of about 8% to about 12% by weight. In other situations, the vinyl polymer will be an aqueous dispersion of polyvinyl acetate having protective colloids of polyvinyl alcohol. In such situations, the vinyl polymer will preferably be about 5% to about 25% by weight of solids of an aqueous dispersion of a polymer of vinyl acetate having colloids of polyvinyl alcohol. Colloidal emulsions of this type are available under the trademark GELVA® emulsion S-77. As discussed below, the vinyl polymer may be further characterized by its coagulation in the presence of an activator.

The present invention preferably includes a glycol. Glycol is intended to have it art-recognized meaning as a carbon based compound containing two hydroxyl groups. Glycols that may be used are those capable of serving as a constituent in the finishes described herein. Preferred glycols include without limitation ethylene glycol, diethylene glycol, propylene glycol and butylene glycol. Propylene glycol is more preferred. By way of example, the finishes of the present invention may contain about 1% to about 50% by weight glycol. Where the glycol is present in an activating liquid, the glycol will preferably be present in about 5% to about 15% by weight. Where the glycol is present in a base material liquid, the glycol will be present in about 30% to about 50% by weight.

The finishes of the present invention may further include water. Water may be used in combination with any of the components of the finish and in any amounts that lead to a desired composition for the application in question. By way of general guidance, water may be present in an amount of about 10% to about 80% by weight of the overall finish. Water contained in a base material liquid is preferably about 40% to about 60% by weight. Water contained in an activating liquid is preferably present in about 75% to about 95% by weight.

The present invention may further include functional fillers. Fillers materials for finishes are well-known in the art and are commercially available. Suitable fillers include but are not limited to potassium silicates (preferably as powder, liquid or flake); sodium silicate (preferably as powder, liquid or beads); potassium feldspar; calcium feldspar, sodium feldspar, third generation super plasticizers; phosphate salts; fly ash; metal oxides; fine sized aggregate (including fly ash, phosphate salt particles, and oxide particles); citric acid; wood ash or potash; MCP; MKP, and polyphosphates of potassium and/or calcium (such as di-calcium phosphate or tri-calcium phosphate); nepheline seyenite; zirconium hydroxide, zirconium oxide and/or zirconium silicate; calcium hydroxide and/or calcium oxide; fine particles of precured phosphate cement; silica fume; magnesium aluminum silicate dispersant; sodium fluorosilicate; mono-potassium phosphate; iron ore slag; grobbar, granulated blast furnace slag and/or iron oxides; small particles of mineral colorants; liquid glazes used internally in the mix, colloidal tin silica, trap rock from the iron mines; silica sand; potash; iron ore floc; ammonium perchlorate; sodium hypochlorite; metakaolin; MCP or MKP with Dequest 2000™ or Dequest 2006™; Surfonyl™; surfactant; MCP anhydrous; MKP anhydrous; red iron oxide; particulate aluminum foil (especially when used with one or more of the following: NaOH or KOH and MKP or MCP and/or KCl or NaCl); magnesium aluminate; potassium perchlorate; silica flour; cmc's and cellulosic materials; zinc oxide; tin, very fine reactive fly ash (for example, Micron-3™; dolomite (either calcined or uncalcined); BPO catalysts; sodium methyl silicates; titanium dioxide; Wollastonite (calcium silicate); fumed or colloidal silicas, stabilized colloidal silicas, and/or silica flour; and cordierite. Obviously, multiple fillers may be used and may be combined with any components of the finish in any amounts that produce a desired composition. Preferably, the fillers will constitute about 5% to 70% by weight of the finish.

The finishes of the present invention may further include colors or colorants. Although the color may be added to any of the components of the finish, preferably, the colorant is added to the base material liquid. The colorants may also be added to either one, two, or more separate volumes of the base material. Suitable colorants include commercial dyes, tints, and pigments. Preferably, the colorant is a type that can be dissolved or dispersed in water (i.e., oil base dyes and pigments are less preferred). Water dispersible pigments are more preferred. A variety of such pigments are commercially available and may contain ethylene glycol, diethylene glycol, and other constituents. For example, white colorants may be titanium dioxide finely ground into diethylene glycol so it mixes well with water.

The finishes of the present invention preferably include an activator. Activators that may be used are those capable of serving the functions described herein. Preferred activators include without limitation muriate of potash and a boric acid product. Muriate of potash is known by several common and chemical names and includes without limitation chloride of potash, dipotassium dichloride, emplets potassium chloride, monopotassium chloride, potassium chloride, potassium chloride solution, potassium monochloride, potassium muriate and tripotassium trichloride. Boric acid compounds are known by several common and chemical names and includes without limitation $BO_3$, boracic acid, borate, boric acid, borofax, boron hydroxide, boron trihydroxide, Orthoboric acid, orthoboric acid, trihydroxyborone, sodium tetraborate, sodium tetraborate decahydrate, disodium tetraborate, sodium metaborate, sodium pentaborate, disodium octaborate tetrahydrate, boric oxide and anhydrous borax. Borax products are also sold under the trademarks 20 MULE TEAM® and BORAX®. Generally, boric acid and borates are preferred with sodium tetra borate decahydrate being more preferred. By way of example, an activating liquid may contain about 1% to about 10% by weight of the activator. In certain situations, about 0.5 ounces to about 10 ounces of dry powder of the activator sodium tetra borate decahydrate is mixed with a gallon of water. The finishes of the present invention preferably do not include phosphoric acid or phosphates.

Standard techniques for applying finishes to substrates will be known to one of ordinarily skill in the art. These techniques include without limitation, coating, dipping, dabbing, brushing, rolling, spraying, troweling, toweling, splattering and sponging. Depending on the particular application, it may be desirable to either completely or partially coat the substrate (or both in the case of successive layers). These situations call for using more or less of the finish as needed. It may also be desirable to simply touch the initial layer with a second layer such as in the case of creating lines, veins, patterns and the like.

The finishes of the present invention (and the components thereof) may be applied to the substrate to the substrate in a variety of manners to provide the finish. In one embodiment, the vinyl polymer may be mixed with the glycol to form a base material liquid (with or without colors) and the activator may be mixed separately with water (and optionally additional glycol) to form an activating liquid. The base material liquid may then be applied to the substrate followed by the application of the activating liquid onto the base material liquid to form the finish. Alternatively, the activating liquid may be applied to the substrate followed by the application of the base material liquid onto the activating liquid to form the finish. In yet another embodiment, the vinyl polymer, the glycol, the water and the activator may all be combined to form the finish and subsequently applied to the substrate.

Regardless of the order of application to the substrate, the result is a decorative finish with desirable appearance and physical characteristics. Once all of the constituents are applied to the substrate, the finish will be smooth, relatively smooth, textured or rough. In certain situations, the finish may be of a thickness that lines or cracks develop upon drying on the substrate such that further manipulation is not needed. Nonetheless, the finish will preferably have properties that allow the user to work with the finish over time, if desired.

While not wishing to be bound by any particular theory, it is believed that the activators of the present invention have the capacity to cross-link or otherwise interact with the vinyl polymer(s) such that the finish is thickened by some manner of complexation. Accordingly, the addition of the activator to the vinyl polymer typically results in a finish that is workable, but does not easily stick to the painted base and/or other substrate. Advantageously, the finish can be altered into decorative patterns without ruining, distorting or smudging the finish. As the mixture is allowed to dry, it adheres to the substrate and becomes a permanent decorative finish.

It is also believed that the glycol acts as a wetting agent, humectant and/or emulsifier in the finish. Accordingly, the slow-drying and other qualities of the glycol increases the malleability and flexibility of the applied finish such that it can be altered after application of the finish to the substrate. As used herein, altered includes without limitation partially or completely removing, touching, modifying, manipulating, flattening, burnishing, polishing, rubbing, brushing, dabbing or sponging the finish. In certain applications, the finish can be altered by merely touching the surface, for example, with a dry absorbent cloth, paper towel, sponge or other similar materials.

As one of ordinary skill in the art will appreciate, the degree to which the finish remains workable over time may depend on the amount of materials used, the nature of the substrate, time, temperature and other factors. For example, the amount of activator in the base material liquid and/or its concentration in the overall mixture may contribute to the end properties of the finish. Similarly, the amount of glycol may also affect the drying (altering) time with more glycol leading to longer drying times. Thus, utilizing the materials and processes of the present invention, an artisan is able to control various factors affecting the workability of the final product, including without limitation, the type of texture and the anti-bonding resistance to the particular substrate on which the materials are applied. The finishes of the present invention can be altered immediately after the application of the finish. More preferably, the finish is altered about five minutes to about 1 hour after application. Even more preferably, the finish is altered about fifteen minutes to about 1 hour after application.

Thus, the present invention allows for the application of differing textures that define various patterns, some of which imitate the natural appearance of glazes, marble, textured stone, and plaster. For certain patterns, the activator may be added to the extent that the resulting mixture becomes very grainy, thick, and chunky. A sufficient amount of activator has been added in this regard when the mixture is no longer able to hold together and naturally separates when applied by brush or trowel to a substrate. The resulting application will be broken color patterns requiring only a minimum amount of touch-up and/or removal of the mixture from the substrate, and only if needed or desired.

The present invention also allows for more significant altering of the applied finish. For example, the addition of the activator typically causes the finish to become somewhat puffed, grainy, and hence very easy to cleanly and sharply manipulate or remove from the substrate. Thus, after applying the finish, it can easily be removed from any surface where it was applied by simply touching the finish to modify the appearance and/or expose the substrate below. Partially removing the finish to expose the substrate is particularly beneficial if the substrate is colored because these colors can form part of the overall surface appearance.

If desired, a wide variety of altering techniques may be used during the drying stages of the finish. For example, the mixture can be burnished or flattened down by applying pressure to the mixture with a plastering or finishing trowel thereby creating a smoother finish. Alternatively, the ability to color tint and then cleanly and sharply remove the finish makes faux marbling easy to achieve. If this look is desired, the finish may be roughly applied to the substrate in basic marble patterns. This finish is then cleanly removed to create a more refined marble appearance. Any mistakes in the removal of the mixture can be repaired by simply painting in more of the finish and, again, cleanly removing the finish where needed and/or desired, without any risk of ruining, smearing or distorting the marble patterns. Veining can also be accomplished through dry brushing or similar technique to create veins that are random and appear more authentic than when created by hand.

The present invention is also ideal for the production of stone-like and/or faux stone finishes. Currently available paints and glazes cannot be cleanly and sharply removed from a substrate to create a sharp-edge pattern (such as in a stone pattern), especially when applied over a textured substrate. The finish and methods of the present invention, however, can be used to expose an underlying textured substrate, thereby imitating the appearance of stone finishes on textured substrates.

The finish may also be partially and randomly spattered or sponged onto the substrate. Using this method, the applied finish is lightly spread on the substrate, typically using a trowel, brush or similar tool. If any refinement and/or exposure of any portion of the underlying substrate color is desired, the applied finish may be removed with a dry cloth, paper towel or similar material. If desired, any finish remaining on the substrate can be further altered (e.g., flattened, further refined with additional detail removal and/or burnished using a finishing trowel, etc.) when the mixture is firm yet not completely dry.

In any of the foregoing applications, the finish may be applied in more than one layer to create a more dimensional or layered finish. In this situation, after one layer of the base material and activator mixture is applied, randomly removed, and allowed to dry, a new layer of the same color or a different color of the finish may be applied over the first layer of mixture and, like the first layer of mixture, randomly removed and/or detailed. This process may be repeated as desired.

The present invention is further demonstrated through the following examples. These examples are for illustrative purposes and are not intended to limit the scope of the invention.

EXAMPLES

Materials and Mixtures

Elvanol=polyvinyl alcohol>97% by weight(<1% by weight methanol and sodium acetate)

Base Material Liquid: density 9.12 lbs/gal (solids by weight 20.95%)
Water: 50.33%by weight
propylene glycol: 28.51% by weight
polyvinyl acetate/polyvinyl alcohol resin solids: 10.63% by weight
sepiolite: 8.44% by weight
silica: 1.88% by weight
other fillers: 0.21% by weight Base Material Liquid (low viscosity) density 8.33 lbs/gal (solids by weight 3.44%)
water: 54.67% by weight
propylene glycol: 41.27% by weight
polyvinyl alcohol: 3.44% by weight
fillers: 0.62% by weight Activating Liquid: density 8.54 lbs/gal (solids by weight 5.16%)
Water: 85.93% by weight
propylene glycol: 8.91% by weight
sodium tetraborate decahydrate: 5.16% by weight

Example 1

A mixture of about 95% by weight Base Material Liquid and about 5% by weight Activating Liquid were mixed together to form a finish of a loose and somewhat rubbery slow drying material with low adhesion properties. Dry powder color was then added to this mixture. Liquid color was also added in a separate experiment. The finish was subsequently brushed onto the substrate. Because of the low adhesion properties of the finish, it did not adhere well in any uniform consistency but rather formed decorative color patterns simply through the application. Due to the slow drying and low adhesion properties of the finish, the color patterns formed by application were then further refined by removal with a dry absorbent cloth without smearing, leaving crisp sharp well-defined color edges.

Example 2

The Activating Liquid was applied to a substrate. Dry powder color was then added to Base Material Liquid. Liquid color was substituted in a separate experiment. This Base Material Liquid and color finish were brushed onto the substrate. This application was also performed with a trowel. Because of the interaction between the Activating Liquid previously applied Base Material Liquid, the finish possessed low adhesion properties and did not adhere well with any uniform consistency. The finish broke apart to form decorative color patterns by the simple application. Although the finish was allowed to dry, due to the slow drying low adhesion properties of the material, the color patterns could have been further refined by removal with a dry absorbent cloth or paper towel, etc. without smearing, leaving crisp sharp well defined color edges.

Example 3

Dry powder color was added to a low viscosity Base Material Liquid. Liquid color and different color mixtures were used in several separate experiments. The slow drying Base Material Liquid (now colored) was applied to a colored substrate in an artistic marble fashion, carefully brush bounced, and then softly brushed smooth. The Base Material Liquid was applied in a marble fashion in a separate experiment. The marble veining was developed by carefully applying the Activating Liquid on top of the Base Material Liquid. Specifically, the Activating Liquid was applied in a random veining pattern with the use of a tool. A brush was used to create the pattern in a separate experiment. After a few minutes, the entire surface was softly dry brushed to remove the Base Material Liquid and color from the randomly applied veining Activating Liquid areas. This technique is particularly useful for very well-defined faux marble and stone.

The invention claimed is:

1. A process for making a faux finish, the process comprising the steps of:

(a) contacting a base material liquid comprising:

about 1% to about 50% by weight propylene glycol;

about 5% to about 25% by weight of solids of an aqueous dispersion of a vinyl polymer selected from the group consisting of polyvinyl acetate, polyvinyl alcohol and a mixture of polyvinyl acetate and polyvinyl alcohol;

with an activating liquid comprising water and an activator selected from the group consisting of a boric acid compound and muriate of potash to form a finish; and (b) applying the finish to a surface.

2. The process according to claim 1, further comprising the step of (c) allowing the finish to completely dry.

3. The process according to claim 1, further comprising the step of (c) altering the shape of the finish about fifteen minutes to about one hour after the finish has been applied to the surface.

4. The process according to claim 1, wherein the vinyl polymer comprises solids of an aqueous dispersion of a polymer of vinyl acetate having protective colloids of polyvinyl alcohol.

5. The process according to claim 1 wherein the activator is sodium tetra borate decahydrate having a ratio of about 0.5 to about 10 ounces by volume of sodium tetra borate decahydrate dry powder per gallon of water.

6. The process according to claim 1, wherein the base material liquid further comprises about 10% to about 80% by weight of water and about 5% to about 70% by weight of a functional filler.

7. A process for making a faux finish, the process comprising contacting:

(a) about 1% to about 25% by weight of a vinyl polymer;

(b) about 10% to about 80% water;

(c) about 20% to about 50% by weight of a glycol; and (d) about 3% to about 10% by weight of an activator; to form the faux finish.

8. The process according to claim 7 wherein the vinyl polymer is selected from the group consisting of polyvinyl acetate, polyvinyl alcohol and a mixture of polyvinyl acetate and polyvinyl alcohol; the glycol is propylene glycol; and the activator is selected from the group consisting of muriate of potash and a boric acid compound.

9. The process according to claim 7, further comprising applying the finish to a surface and allowing the finish to completely dry.

10. The process according to claim 9 wherein the vinyl polymer is selected from the group consisting of polyvinyl acetate, polyvinyl alcohol and a mixture of polyvinyl acetate and polyvinyl alcohol; the glycol is propylene glycol; and the activator is selected from the group consisting of muriate of potash and a boric acid compound.

11. The process according to claim 7, further comprising applying the finish to a surface and altering the shape of the finish about five minutes to about one hour after the finish has been applied to the surface.

12. The process according to claim 11 wherein the vinyl polymer is selected from the group consisting of polyvinyl acetate, polyvinyl alcohol and a mixture of polyvinyl acetate and polyvinyl alcohol; the glycol is propylene glycol; and the activator is selected from the group consisting of muriate of potash and a boric acid compound.

13. The process according to claim 7, wherein contacting comprises the steps of:

(1) contacting the vinyl alcohol, the glycol, the water and the activator to form the finish; and (2) applying the finish to a surface.

14. The process according to claim 7, wherein contacting comprises the steps of:

(1) contacting the activator with a portion of the glycol to form an activating liquid; (2) applying the activating liquid to a surface; (3) contacting the vinyl alcohol with another portion of the glycol to form a base material liquid; and (4) applying the base material liquid onto the activating liquid to form the finish.

15. A process for making a faux finish, the process comprising (1) contacting a vinyl polymer and a glycol to form a base material liquid; (2) applying the base material liquid to a surface; (3) contacting an activator with water to form an activating liquid; and (4) applying the activating liquid onto the base material liquid to form a finish.

16. The process according to claim 14 wherein the vinyl polymer is selected from the group consisting of polyvinyl acetate, polyvinyl alcohol and a mixture of polyvinyl acetate and polyvinyl alcohol; the glycol is propylene glycol; and the activator is selected from the group consisting of muriate of potash and a boric acid compound.

17. The process according to claim 15 further comprising adding a colorant to the base material liquid.

18. The process according to claim 16, further comprising allowing the finish to completely dry.

19. The process according to claim 16 further comprising altering the shape of the finish after about 5 minutes to about one hour of applying the activating liquid onto the base material liquid.

20. The process according to claim 17 further comprising partially removing the finish after about 5 minutes to about one hour.

21. The process according to claim 19, wherein the finish is altered by one or more of touching, brushing, rubbing, manipulating, burnishing, troweling, toweling, sponging, flattening or removing the finish.

* * * * *